US007059470B2

(12) United States Patent
Slankster

(10) Patent No.: US 7,059,470 B2
(45) Date of Patent: Jun. 13, 2006

(54) REMOVABLE GOLF BAG SLEEVE

(75) Inventor: Donald William Slankster, Novi, MI (US)

(73) Assignee: Slankster Corporation, Novi, MI (US)

( * ) Notice: Subject to any disclaimer, the term of this patent is extended or adjusted under 35 U.S.C. 154(b) by 172 days.

(21) Appl. No.: 10/755,998

(22) Filed: Jan. 13, 2004

(65) Prior Publication Data

US 2005/0150794 A1 Jul. 14, 2005

(51) Int. Cl.
*A63B 55/00* (2006.01)

(52) U.S. Cl. ..... 206/315.3; 206/315.2; 206/315.7

(58) Field of Classification Search ..... 206/315.2, 206/315.3, 315.6, 315.7; 248/96; 211/70.2
See application file for complete search history.

(56) References Cited

U.S. PATENT DOCUMENTS

| | | | | | |
|---|---|---|---|---|---|
| 1,555,019 | A * | 9/1925 | MacDonald | 206/315.3 |
| 1,960,099 | A * | 5/1934 | Donovan | 248/96 |
| 2,595,987 | A * | 5/1952 | Shears | 206/315.6 |
| 4,561,525 | A * | 12/1985 | Shidner | 190/106 |
| 4,739,958 | A * | 4/1988 | Sato | 248/96 |
| 4,838,416 | A * | 6/1989 | Carman | 206/315.2 |
| 4,881,638 | A * | 11/1989 | Cho | 206/315.3 |
| 4,911,292 | A * | 3/1990 | Airey, Jr. | 206/315.3 |
| 5,358,109 | A * | 10/1994 | Nichols | 206/315.3 |
| D352,392 | S * | 11/1994 | Little | D3/255 |
| 5,472,084 | A * | 12/1995 | Aliano, Jr. | 206/315.3 |
| 5,918,737 | A * | 7/1999 | Kwon | 206/315.3 |
| 5,984,395 | A * | 11/1999 | Halpen | 294/143 |
| 6,247,619 | B1 * | 6/2001 | Gill et al. | 222/105 |
| 6,330,944 | B1 * | 12/2001 | DeMichele | 206/315.3 |
| 6,499,593 | B1 * | 12/2002 | Uner et al. | 206/315.3 |
| 6,595,357 | B1 * | 7/2003 | Sutter et al. | 206/315.6 |
| 6,640,970 | B1 * | 11/2003 | Townsend, Jr. | 206/315.2 |
| 2002/0066763 | A1 * | 6/2002 | Hsueh | 224/901.2 |
| 2002/0144917 | A1 * | 10/2002 | Barrise et al. | 206/315.3 |
| 2002/0195359 | A1 * | 12/2002 | Uner et al. | 206/315.3 |
| 2004/0026279 | A1 * | 2/2004 | Miller | 206/315.2 |
| 2004/0188288 | A1 * | 9/2004 | Parpart | 206/315.7 |

FOREIGN PATENT DOCUMENTS

WO WO 91/18650 * 12/1991

* cited by examiner

*Primary Examiner*—Sue A. Weaver

(57) ABSTRACT

A removable golf sleeve that is easily coupled to and uncoupled from a golf bag. The sleeve is configured to hold one or more clubs easily and be easily transportable to and from the golf bag. The golf sleeve is formed as a durable, lightweight flexible bag having a highly visible collar, handle and loop. The bag is large enough to hold multiple golf clubs in such a way as to prevent water and dirt from accumulating on the grips, even if the sleeve is set down on wet or dirty ground. The golf sleeve has one or more attachment features used to releasably couple the removable golf sleeve to the interior or exterior of the golf bag. The removable golf sleeve may also be formed with an incorporated tripod stand that allows the collar to remain off the ground when the sleeve is uncoupled from the golf bag.

19 Claims, 3 Drawing Sheets

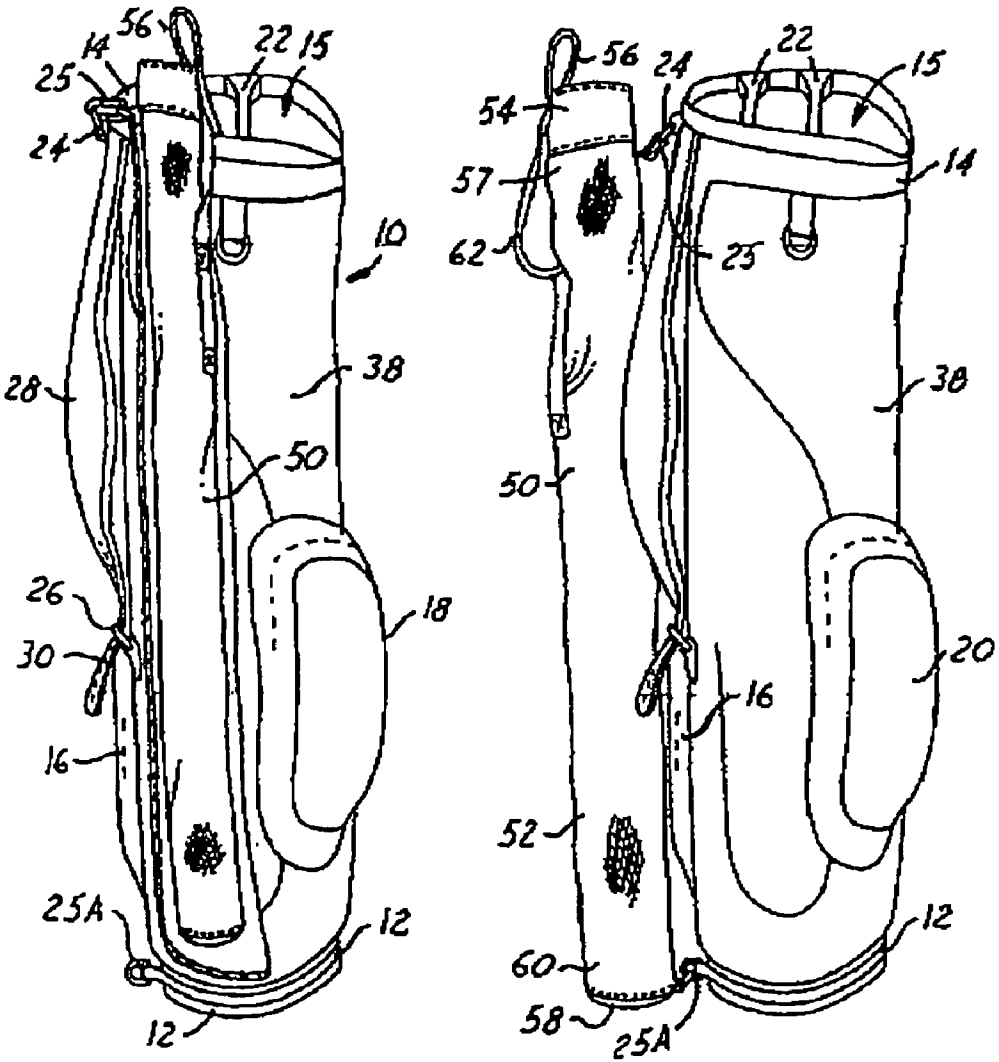
FIG. 1
FIG. 2
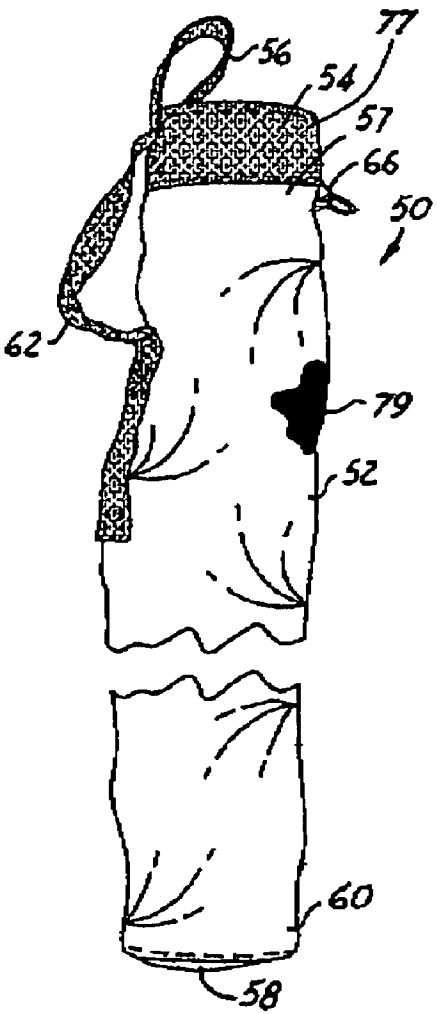
FIG. 3

REMOVABLE GOLF BAG SLEEVE

TECHNICAL FIELD

The present invention relates generally to a golf club carrying devices and more specifically to a removable golf bag sleeve that is portable.

BACKGROUND ART

During a game of golf, golfers typically carry a set of golf clubs in a golf bag or the like. Conventional golf bags are usually fabricated from a relatively soft material and are open at the upper end to allow access to the clubs contained within the golf bag. Conventional golf bags have one or more straps that are utilized to carry the bag on the user or caddy's shoulder. Alternatively, some golfers may choose to strap the golf bag to a motorized cart or a handcart. In fact, on many new golf courses, the use of motorized carts is required or all golfers.

While a golf bag provides a convenient method of carrying a set of golf clubs, and golf carts further facilitate the mobility of such clubs, it is still often impractical to carry the entire set of golf clubs to every shot.

For example, a golfer near a putting green typically needs only short-range clubs, such as a putter, a pitching or sand wedge, or perhaps a lob wedge. As it is usually against the course rules to place a golf bag or drive a golf cart on or near the putting greens, golfers frequently find their entire set of clubs quite a distance from where they must actually make a shot. As a result, golfers typically remove a subset of clubs from their golf bag and transport the clubs by hand to their golf ball at a location near the putting green.

Another example of the impracticality of bringing one's entire set of clubs to the ball is evident where golf courses do not allow a golf cart to be driven off of a paved trail. Many golf balls, of course, land a considerable distance from such paved trails. It is clearly impractical, in such a situation, to unstrap the golf bag from the golf cart each and every time one leaves the cart to find the ball. In addition, where pace of play is strictly enforced, it may also be impractical in terms of time considerations. More likely, the golfer will try to anticipate which clubs he or she may need and then bring that particular subset of clubs to the ball. However, if the golfer guesses incorrectly and does not bring the correct club, he must walk back to his golf bag and get the correct club or play the shot with a club that the golfer would preferably not use.

In all such situations, where a golfer is away from his golf bag with a subset of his golf clubs, several problems become evident. First, after a golfer has selected the proper club for the shot, the remaining clubs are typically laid on the ground near the golfer. This not only causes the handles of these clubs to contact a potentially wet and dirty grass surface, but the possibility of forgetting these clubs after the shot is greatly increased. Moreover, while it is easy to carry one golf club, it is not always easy to carry two or three. Still further, while picking golf clubs up from the ground is not all that difficult, it does require the golfer to bend down and scoop the shafts up with his hand, which inevitably causes a golfers hand or glove to become wet and soiled unnecessarily. Finally, in areas of deep grass, one or more clubs may be submerged within the grass and inadvertently be left behind after the golfer executes the shot.

It is thus highly desirable to provide a golf club carrier that is easy to use and transport and addresses each of these concerns.

SUMMARY OF THE INVENTION

The present invention provides a removable golf sleeve that is easily coupled to and uncoupled from a golf bag. The golf sleeve is preferably coupled to the exterior of the golf bag, and stored within the interior of the bag, for easy accessibility. The golf sleeve is configured to hold one or more clubs easily and be easily transportable to and from the golf bag.

The golf sleeve is preferably formed as a nylon bag having a highly visible collar, handle and loop. The nylon bag is large enough to hold multiple golf clubs in such a way as to prevent water and dirt from accumulating on the grips, even if the sleeve is set down on wet or dirty ground. The golf sleeve has one or more attachment features used to releasably couple the golf sleeve to the exterior of the golf bag. The golf sleeve is preferably coupled to the golf bag such that the bag portion is contained within the interior of the golf bag, but may also be coupled such that the nylon bag is exterior to the golf bag.

The collar surrounds and is sewn into the upper half of the golf sleeve and provides the open upper end through which golf clubs may be introduced to the nylon bag. The collar also has one or more rings sewn therein that are used to releasably attach the golf sleeve to the golf bag at the upper end.

The handle primarily functions as the mechanism by which the golfer grips the sleeve to transport it to and from the golf ball. The handle is sewn onto the nylon bag and within the collar such that the handle is easily picked up by the golfer off the ground with a minimal chance of the golfer touching the ground, therein minimizing or preventing the golfer from getting his hand, with or without a golf glove, wet or dirty.

The loop is sewn into the top of the collar and primarily functions as an alternative handle for picking the sleeve up out of the golf bag or for picking the sleeve up off the ground after use. The loop may alternatively function as an easy attachment point for the sleeve to the bag. For example, the loop could be placed around the top of an umbrella, which is typically carried on the exterior of a golf bag.

The collar, loop, and handle are typically formed of the same material as the rest of the nylon bag, but are formed in an alternative, bright color (such as bright yellow) that contrasts with the nylon bag portion. This decreases the chances that the golfer will forget to retrieve the sleeve after executing a shot.

In an alternative preferred embodiment, a tripod stand could be incorporated into the nylon bag. The tripod stand opens when the bag is placed with its bottom portion on the ground, and functions to prop the bag such that the collar remains above the surface of the ground, therein allowing easy access to the clubs contained with the bag and further preventing water accumulation potential on the grips or shafts.

Other objects and advantages of the present invention will become apparent upon the following detailed description and appended claims, and upon reference to the accompanying drawings.

BRIEF DESCRIPTION OF THE DRAWINGS

FIG. 1 is a cut-away perspective view of a golf bag having a removable golf sleeve according to a preferred embodiment of the present invention.

FIG. 2 is a perspective view of a golf bag having a removable golf sleeve according to another preferred embodiment of the present invention.

FIGS. 3–5 are perspective views of the removable golf sleeve of FIG. 1.

DETAILED DESCRIPTION OF THE PREFERRED EMBODIMENT

Figure 4:
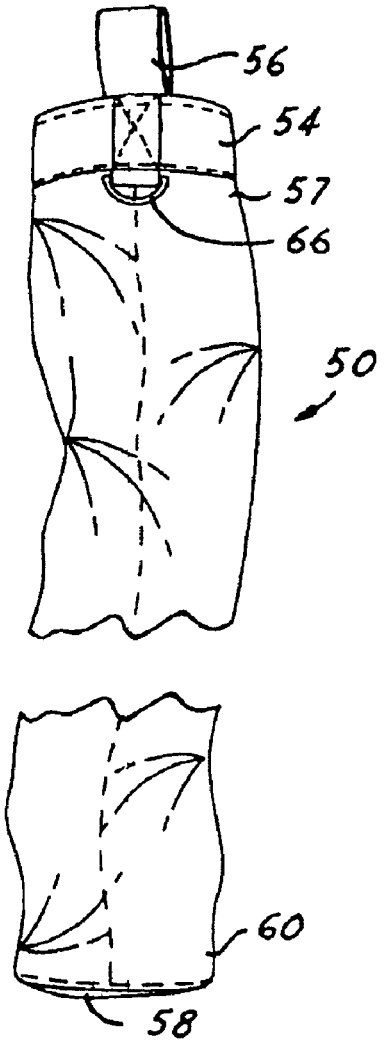

Referring now to FIG. 1, a cut-away perspective view of a typical golf bag 10 used by most golfers today. The golf bag 10 is generally cylindrical in shape and has a solid bottom 12 and an open and relatively rigid top end 14 for receipt of golf clubs with an interior region 15. The golf bag 10 has one or more zippered storage pockets 16, 18 located near the bottom 12 for receipt of various golf items, including, for example, golf balls and golf tees. The golf bag 10 may also have one or more larger zippered storage pockets for storage of clothing or other items. The open end 14 is typically formed with a number of partitions 22 to separate the golf clubs. A metal ring 24 is typically sewn within a portion of the open end 14. A clip 25 may be coupled to the metal ring 24 or elsewhere on the golf bag 10. The clip 25 is typically used for retaining a golf towel (not shown).

Also coupled to the outside of the bag is a buckle portion 26. The golf bag 10 comes with an adjustable carrying strap 28 that is clipped within the metal ring 24 and strapped within the buckle portion 26. A series of holes 30 within the carrying strap allow the length of the strap 28 to be easily adjusted. The golf bag 10 also may also have a series of sewn-in loops that are used to hold an umbrella.

The golf bag 10 may be collapsible between the solid bottom 12 and top end 14. In this type of bag 10, the outer surface 38 of the bag is made of nylon or some type of flexible plastic material. The golf bag 10 may also be semi-rigid between the solid bottom 12 and top end 14. The outer surface 38, in this embodiment, may be made of leather or a synthetic material simulating the look and feel of leather.

The portions of the golf bag 10, as described above, may be considered typical and are not meant to be limited to the illustrated configuration. The purpose of describing the components of the golf bag 10 is described to illustrate the removable golf sleeve 50, which is the essence of the present invention.

Also shown in FIG. 1, is a removable golf sleeve 50 shown in one preferred embodiment of the present invention. As shown in FIG. 1, the removable golf sleeve 50 is inserted into the interior region 15 of the golf bag 10 and releasably attached to the golf bag 10 using clip 25. When a golfer has a shot that is located at a distance from the location of his golf bag 10, the golfer simply places one or more golf clubs in the sleeve 50 and unclips and removes the sleeve 50 from the golf bag 10.

In an alternative preferred embodiment, as shown in FIG. 2, the removable golf sleeve 50 is contained on the exterior of the golf bag and is releasably coupled to the bag using clip 25. In addition, a second optional clip 25A contained on the exterior of the golf bag 10 near the bottom of the golf bag 10 may be used to releasably couple the bottom structure 58 of the golf sleeve 50 to the golf bag 10.

Figure 5:
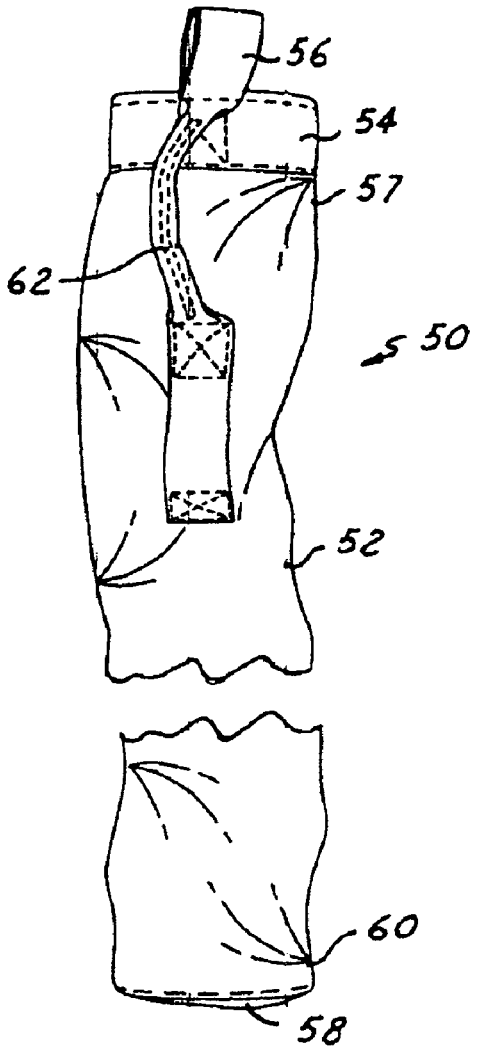

A more detailed explanation of the golf sleeve 50 is illustrated in two preferred embodiments as shown in FIGS. 3–5 below.

Figure 6:
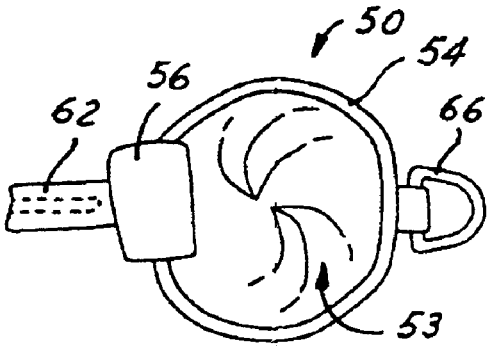
FIG. 6 is a top view of the golf sleeve according to one preferred embodiment of the present invention.

Referring now to FIGS. 3–5, the golf sleeve 50 is preferably formed as a durable bag structure 52 having a sewn in, highly visible collar 54 at one end 57 and a sewn-in bottom structure 58 attached at the opposite closed end 60. The sleeve 50 also has a highly visible handle 62 sewn into the collar 54 at the top end and nylon bag 52 at its bottom end. A loop 56 is also sewn into the collar 54. As best shown in FIGS. 3 and 6, attached to the collar 54 is a metal ring 66 that is used to reversibly attach the sleeve 50 to the golf bag 10.

The durable bag structure 52 is preferably formed of a lightweight, flexible, water-resistant material that is enclosed on one end with the bottom structure 58 and open on the other end terminating in the sewn-in collar 54. The bag 52 is large enough to hold multiple golf clubs in such a way as to prevent water and dirt from accumulating on the grips of the golf clubs, even if the sleeve 50 is set down on wet or dirty ground.

One preferred material for use as the bag structure 52 is nylon, and more specifically 400-denier nylon. The length (l) of the bag structure 52 should be slightly less than the length of an average golf club and slightly less than the length of the golf bag 10 into which it is inserted so that it may be maintained in the interior region 15 while holding one or more golf clubs.

The bottom structure 58 is preferably formed of a durable plastic material that is sewn around the closed end 60 of the bag structure 52 to form an enclosure. It is preferable that the bottom structure 56 reinforces the bag structure 52, as such the bottom structure is formed to be more durable than the bag structure 52. This is necessary to protect the grip portion of the golf clubs, which will lie against the bottom structure 58 as the sleeve 50 is transported to and from the golf ball. This also protects the bottom of the nylon bag 52 against the weight of the golf clubs during use. One durable plastic material that may be used in the bottom structure 58 is 1000-denier nylon.

The collar 54 surrounds and is sewn into the upper half of the nylon bag 52 and provides the open upper end through which golf clubs may be introduced to the interior 53 of the nylon bag 52. The collar 54 also has one or more rings 66 sewn therein that can be used to releasably attach the golf sleeve to the golf bag at the upper end.

Figure 7:
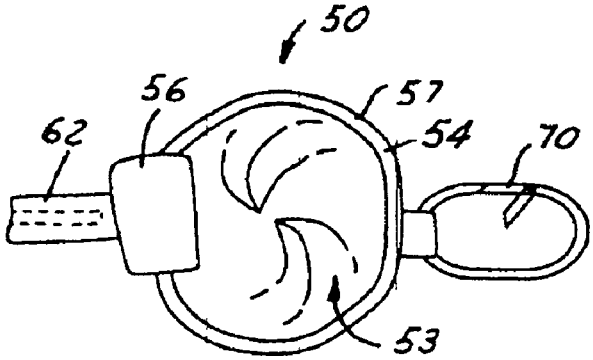
FIG. 7 is a top view of the golf sleeve according to another preferred embodiment of the present invention.

As shown in FIGS. 1 and 2 in conjunction with the sleeve 50 as shown in FIGS. 3–6, a clip 25 is primarily secured to the metal ring 24 on the golf bag 10 and may be releasably coupled to one of the metal rings 66 to attach the sleeve 50 to the golf bag 10 during non-use. Alternatively, as shown in FIG. 7, the clip 70 may be primarily secured to the metal ring 66 and releasably clipped to a metal ring 24 on the golf bag 10 to attach the sleeve 50 to the golf bag 10 during non-use.

The collar 54, loop 56, and handle 62 are formed in an alternative, bright color (such as bright yellow as shown in FIG. 3 under reference numeral 77) that contrasts with the nylon bag portion 52, which is typically a muted color (a portion of the nylon bag 52 is shown colored black in FIG. 3 as reference numeral 79). This decreases the chances that the golfer will forget to retrieve the sleeve 50 after executing a golf shot. As one of ordinary Skill in the art will appreciate, the color of the collar 54, loop 56, and/or handle 62 may alternatively be muted, while the nylon bag structure 52 is brightly colored and achieve the same contrasting effect.

The loop 56 is sewn into the top of the collar 54 and primarily functions as an alternative handle for picking the sleeve 50 up out of the golf bag 10 or for picking the sleeve 50 up off the ground after use. The loop 56 may alternatively function as an easy attachment point for the sleeve 50 to the golf bag 10 when clips 25 or 70 are not used. For example, the loop 56 could be placed around the top of an umbrella, which is typically carried on the exterior of a golf bag 10. The loop 56 preferably is formed of similar materials to the handle 62 and collar 54.

The collar 54, loop 56, and handle 62 are formed in an alternative, bright color (such as bright yellow) that contrasts with the nylon bag portion 52, which is typically a muted color (such as black). This decreases the chances that the golfer will forget to retrieve the sleeve 50 after executing a golf shot. As one of ordinary skill in the art will appreciate, the color of the collar 54, loop 56, and/or handle 62 may alternatively be muted, while the nylon bag structure 52 is brightly colored and achieve the same contrasting effect.

Figure 8:
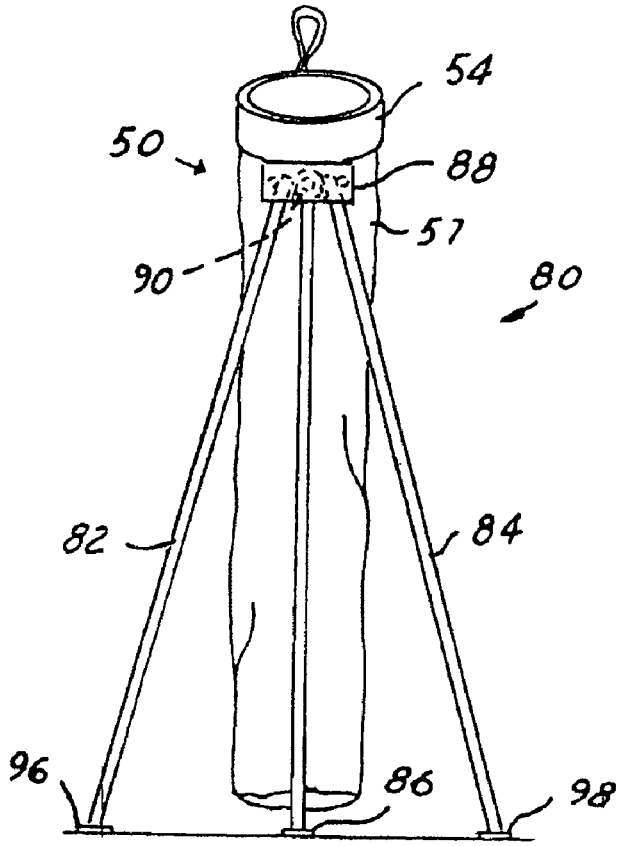
FIG. 8 is a perspective view of a removable sleeve according to another preferred embodiment of the present invention.
Figure 9:
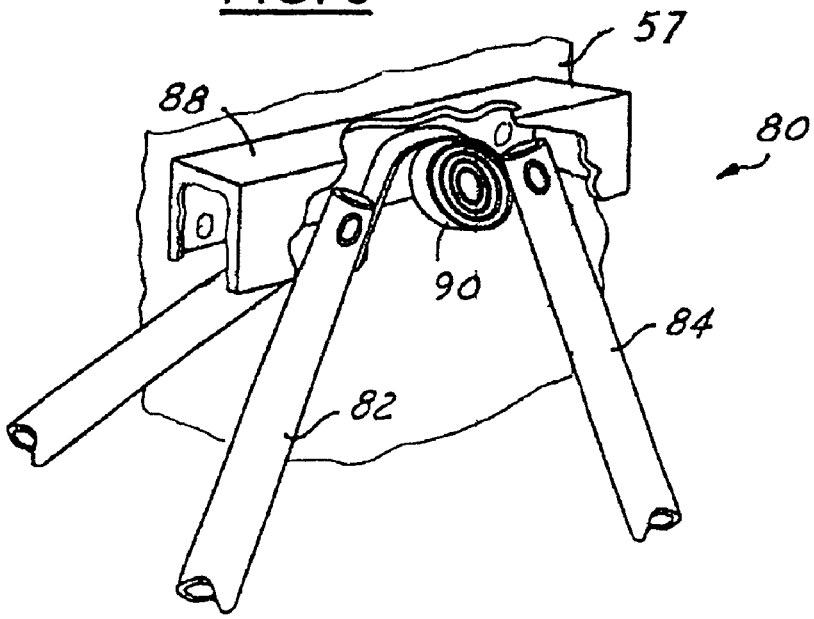
FIG. 9 is a close-up view of a portion of FIG. 8.

Referring now to FIGS. 8 and 9, an alternative preferred embodiment of the golf sleeve 50 is illustrated as having a two-position tripod leg stand 80 in attached relation, to the portion of the durable bag structure 52, or more preferably to the collar 54. The tripod leg stand 80 allows the sleeve 50 to be set down such that the collar 54 and handle 62 is maintained above ground, therein preventing water or dirt from adhering to the collar 54 or handle 62 and also preventing water or dirt from entering the interior of the nylon bag 54 at the collar 54. This minimizes or prevents the golfer from getting his hand, with or without a golf glove, wet or dirty when utilizing the sleeve 50. This also aids in preventing water and dirt from accumulating on the grips of the golf clubs as they are removed from the sleeve 50.

The tripod leg stand 80 consists essentially of two spread apart angularly oriented legs 82, 84 rotatably fixed within a pivotal mounting portion 88 high on the bag portion 52 at a location near the collar 54, or alternatively mounted within the collar 54. The pivotal mounting portion 88 is affixed to the bag portion 52 or collar in any number of different methods, including, for example, through the use of rivets. A shoe 86 or similar device disposed flush with the bottom portion 58 of the sleeve 50 and coupled to the pivoting mounting portion 88 via springs 90 is used to control the deployment of the legs 82, 84 to an open position from a closed position.

In the closed position, characterized when the sleeve 50 is being detached from the golf bag 10 or attached to the golf bag 10 without the shoe 86 touching the ground, the legs 82, 84 are maintained along the length of the bag portion 58 of the sleeve 50.

When the collar 54 is urged forwardly relative to the bottom portion 58 and shoe 86 (i.e., the open position), the total weight of the sleeve 50 and its contents are urged onto the shoe 86. This causes the shoe 86 to rise, therein causing the springs 90 to rise in response and forcing the legs 82, 84 to pivot outward from the mounting portion 88. The bottom 96, 98 of the respective legs 82, 84 are then placed on the ground such that the length of the bag portion 52 is rested at an angle relative to the ground. This allows the collar 54 to be maintained at a position above the ground and within easy access to the golfer. To move the bag back to the closed position, simply lift the sleeve 50 off the ground, or urge the sleeve backward relative to the bottom portion 58 and shoe 86, such that the shoe 86 is urged back downwardly to its resting position by springs 90.

While one particular embodiment of the invention have been shown and described, numerous variations and alternative embodiments will occur to those skilled in the art. Accordingly, it is intended that the invention be limited only in terms of the appended claims.

What is claimed is:

1. A removable golf sleeve for use with a golf bag, the removable golf sleeve comprising:

a durable, lightweight flexible bag structure having an open end and a closed bottom, said open end and closed bottom together defining an interior region, said interior region sufficiently sized lengthwise from said open end to said closed bottom to retain a substantial portion of at least one golf club;

a collar coupled around said open end;

a handle coupled to said durable bag structure;

a loop coupled to said durable bag structure;

wherein said collar, said handle, and said loon have a first color;

an attachment device for releasably coupling the removable golf sleeve to the golf bag such that said durable, lightweight flexible bag structure is substantially contained within an interior region of the golf bag; and wherein said durable, lightweight flexible bag structure has a second color, said first color substantially contrasting with said second color such that the removable golf sleeve is highly visible.

2. The removable golf sleeve of claim 1, wherein said durable, lightweight flexible bag structure comprises a nylon bag structure.

3. The removable golf sleeve of claim 2, wherein said nylon bag structure comprises a 400-denier nylon bag structure.

4. The removable golf sleeve of claim 1 further comprising a bottom structure coupled to said closed bottom.

5. The removable golf sleeve of claim 4, wherein said bottom structure comprises a 1000-denier nylon material sewn to an outer portion of said closed bottom.

6. The removable golf sleeve of claim 1, wherein said collar comprises 1000-denier nylon sewn to said open end of said durable, lightweight flexible bag structure.

7. The removable golf sleeve of claim 1, wherein said handle comprises 1000-denier nylon sewn to said durable, lightweight flexible bag structure.

8. The removable golf sleeve of claim 1, wherein said loop comprises 1000-denier nylon sewn to said durable, lightweight flexible bag structure.

9. The removable golf sleeve of claim 1, wherein said attachment device comprises a metal ring retained between said collar and said durable, flexible bag structure.

10. The removable golf sleeve of claim 9, wherein said attachment device further comprises a clip coupled to said metal ring.

11. The removable golf sleeve of claim 1 further comprising a two-position tripod golf stand coupled to said durable, lightweight flexible bag structure.

12. A golf club carrying device comprising:

(a) a golf bag having a first attachment device and an interior region; and (b) a removable golf sleeve releasably coupled to said golf bag such that a substantial portion of said removable golf sleeve is contained within said interior region, said removable golf sleeve comprising:

a durable, lightweight flexible bag structure having an open end and a closed bottom, said open end and closed bottom together defining an interior region, said interior region sufficiently sized lengthwise from said open end to said closed bottom to retain a substantial portion of at least one golf club;

a collar coupled around said open end;

a handle coupled to said durable bag structure:

a loop coupled to said durable bag structure;

a bottom structure sewn to an outer portion of said closed bottom, wherein said bottom structure comprises a 1000-denier nylon material; and a second attachment device for releasably coupling the removable golf sleeve to said first attachment device.

13. The removable golf sleeve of claim 12, wherein said durable, lightweight flexible bag structure comprises a 400-denier nylon bag structure.

14. The removable golf sleeve of claim 12, wherein said collar, said handle, and said loop each comprise 1000-denier nylon sewn to said durable, lightweight flexible bag structure.

15. The removable golf sleeve of claim 12, wherein said collar, said handle, and said loop have a first color, and wherein said durable, lightweight flexible bag structure has a second color, said first color substantially contrasting with said second color such that the removable golf sleeve is highly visible.

16. The removable golf sleeve of claim 12, wherein said second attachment device comprises a metal ring retained between said collar and said durable, flexible bag structure.

17. The removable golf sleeve of claim 16, wherein said first attachment device comprises a clip, said clip being capable of being releasably coupled to said metal ring to releasably attach said removable golf sleeve to said golf bag.

18. The removable golf sleeve of claim 16, wherein said attachment device further comprises a clip coupled to said metal ring, said clip capable of being releasably coupled to a second metal ring on said golf bag to releasably attach said removable golf sleeve to said golf bag.

19. The removable golf sleeve of claim 12 further comprising a two-position tripod golf stand coupled to said durable, lightweight flexible bag structure.

* * * * *